US005278362A

United States Patent [19]

Ohashi

[11] Patent Number: 5,278,362

[45] Date of Patent: Jan. 11, 1994

[54] PUSH-BUTTON SWITCH WITH DISPLAY DEVICE

[75] Inventor: Shigeo Ohashi, Tokyo, Japan

[73] Assignee: Nihon Kaiheiki Industrial Company, Ltd., Japan

[21] Appl. No.: 909,198

[22] Filed: Jul. 6, 1992

[30] Foreign Application Priority Data

Dec. 26, 1991 [JP] Japan ..... 3-343758

[51] Int. Cl.[5] ..... H01H 9/26

[52] U.S. Cl. ..... 200/5 A; 200/314

[58] Field of Search ..... 200/5A, 5C; 512-517; 310-314, 341-345

[56] References Cited

U.S. PATENT DOCUMENTS 4,501,937 2/1985 Anderson et al. ..... 200/5 A 4,987,279 1/1991 Hirose et al. ..... 200/314

*Primary Examiner*—A. D. Pellinen

*Assistant Examiner*—Michael A. Friedhofer

*Attorney, Agent, or Firm*—Lorusso & Loud

[57] ABSTRACT

In a push-button switch with a display device for opening and closing an electric circuit by pressing an operating button, a touch panel is disposed on the top side of the operating button. First a second switch device which relies upon the touch panel is operated using the operating button, and then a first switch device which relies upon pressing of the operating button is operated, thereby preventing erroneous operation.

7 Claims, 7 Drawing Sheets

PUSH-BUTTON SWITCH WITH DISPLAY DEVICE

BACKGROUND OF THE INVENTION

This invention relates to a push-button switch and, more particularly, to a push-button switch with a display device, in which a touch panel is arranged on the top side of a push-button switch and a plurality of switching devices are disposed on a single operating button.

In the prior art, a push-button switch of this kind is provided with an LCD (liquid-crystal display) element arranged as a display device on the top side of an operating button. The LCD element is made to display the function of the push-button switch by an IC having a driver circuit and the like, and the switching operation is performed by moving the operating button up and down.

In another example of such a push-button switch, an LCD element is arranged on the under side of a transparent-electrode switch of the type in which transparent electrodes are set on the inner surfaces of a pair of transparent, electrically insulative sheets arranged facing each other across a prescribed gap. The LCD element is made to display the function of the transparent-electrode switch, and the switching operation is performed by pressing the transparent electrodes of the transparent-electrode switch thus made to present a display.

A disadvantage of these conventional push-button switches is that the switch can be operated accidentally as a result of the push-button being contacted inadvertently by the arm or some other object. This can cause the generation of an erroneous signal and result in a changed display while the operator is unaware. One consequence can be a major accident.

Another problem is that since the switch having the touch panel is operated merely by touching the panel with a finger, the operator has no sensation of having actually operated the switch. In other words, the switch does not provide the operator an adequate operating sensation.

SUMMARY OF THE INVENTION

An object of the present invention is to provide a push-button switch with a display device adapted to prevent the aforementioned problem, namely erroneous operation of the push-button switch due to carelessness, and to obtain an adequate operating sensation, and which has a plurality of switching devices the operating direction of which is made the same.

According to the present invention, the foregoing object is attained by providing a push-button switch, equipped with a display device, for switching an electric circuit by pressing an operating button, wherein there is provided a switch device having a touch panel disposed on the top side of the operating button, in addition to a switch device operated by up-and-down movement of the operating button, whereby a plurality of switching devices are operated by a single operating button.

In accordance with the present invention, a switch device having a touch panel disposed on the top side of an operating button is provided in addition to a switch device operated by up-and-down movement of the operating button, as set forth above. As a result, the electric circuit cannot be switched merely by touching the touch panel on the top side of the operating button. The electric circuit can be switched only by both touching the touch panel and pressing down the operating button as well.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Figure 1:
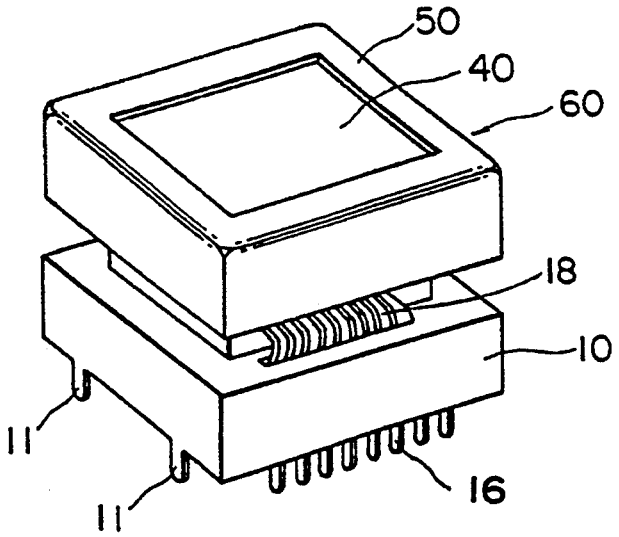
FIG. 1 is a perspective view of a push-button switch illustrating an embodiment of the present invention.

An embodiment of the present invention will now be described in detail with reference to the drawings.

As shown in FIGS. 1 through 5(*a*)–(*c*), a switch body 10 is projectively provided with fixing pieces 11, which extend downwardly from the lower portion of the switch body 10, in order to fix the switch body 10 to a substrate (not shown). The upper portion of the switch body 10 is formed to have a connector connecting hole 12, a plunger insertion hole 14, etc. Further, one edge of a strip-shaped flexible printed wiring board 18 on which a circuit pattern 19 is formed is placed in the connector connecting hole 12, and the terminus of the flexible printing wiring board 18 is connected to terminals 16 secured to the switch body 10. The other edge of the flexible printed wiring board 18 is connected to a circuit pattern (not shown) on a printed circuit board 25. Current is fed to an IC chip 26, a light-emitting diode (LED) 27 and an LCD element (liquid-crystal display device) 30 via the circuit pattern. In addition, the LCD element 30 and the light-emitting diode 27, etc., are driven by the IC chip 26, which is mounted on the printed circuit board 25, via the circuit pattern. A touch panel 40 is disposed on the LCD element 30. The touch panel 40, as shown, for example, in FIG. 3, includes a lower transparent insulative sheet 41 on which a transparent electrode (ITO, for example) 42 is provided, and an upper transparent insulative sheet 43 on which a transparent electrode (ITO, for example) 44 is provided. The transparent electrodes 42, 44 are arranged to oppose each other. A push-button cap 50, which is formed to have a square hole 51, is disposed to cover the touch panel 40, the LCD element 30, connectors 28, the light-emitting diode 27 and the printed circuit board 25 while leaving the top side of the touch panel 40 exposed.

As described above, the touch panel 40 and the LCD element 30 are provided within the push-button cap 50 having the square hole 51 in its top side, and the connectors 28 are arranged opposing the bottom side of the LCD element 30 to effect a connection to the circuit pattern on the printed circuit board 25.

Further, the light-emitting element (LED) 27 is arranged so as to oppose, at right angles, both connectors 28 on the bottom side of the LCD element 30.

A plunger 20 is situated below the printed circuit board 25. The plunger 20, which is formed to have a generally C-shaped configuration, comprises a horizontal planar portion 21 and a depending portion 22 extending downwardly from both the left and right sides of the horizontal planar portion 21. The depending portion 22 is formed to have a resilient claw 23 upstanding from the side face of the depending portion. Numeral 24 denotes a notch for imparting the resilient claw 23 with flexibility. When the resilient claw 23 is pressed into the plunger insertion hole 14, the resilient claw 23 engages a recess 15 within the plunger insertion hole 14, whereby the plunger 20 is prevented from falling out.

The plunger 20 is installed with the outer peripheral surface of its horizontal planar portion 21 fitted into a recess (not shown) provided in the inner surface of the push-button cap 50. In a case where the push-button cap 50 is to be removed, the depending portion 22 is pressed inwardly by a jig such as a screwdriver, in which state the push-button cap 50 can be pulled off in the upward direction.

The flexible printed wiring board 18 is flexed and bent within the generally C-shaped interior of the plunger 20, and the distal end thereof is connected to the terminals 16, which serves as a connecting member, provided on the switch body 10. The depending portion 22 on each of the two sides of the plunger 20 is inserted into the corresponding plunger insertion hole 14 of the switch body 10, thereby installing the plunger. By pressing an operating button 60, the plunger 20 descends to actuate the driving portion of an ordinary contact mechanism, thereby opening and closing the contacts of an electric circuit.

On the other hand, when the touch panel 40 is touched, the transparent electrodes 42 and 44 are brought into contact to close the electric circuit between them. The operating state of the touch panel 40 is controlled by being connected to the IC chip 26, which is mounted on the printed circuit board 25, via a lead 45.

Figure 5A:
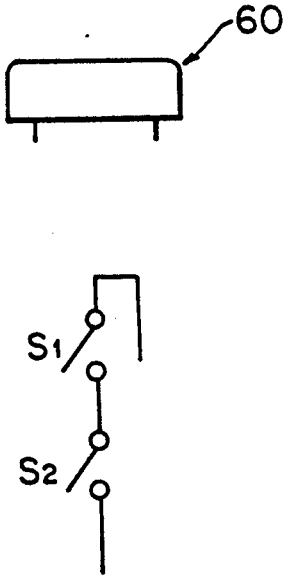
FIGS. 5(*a*) through 5(*c*) are explanatory views regarding the operated state of the push-button switch illustrating the embodiment of the present invention and the switching of an electric circuit.
Figure 5B:
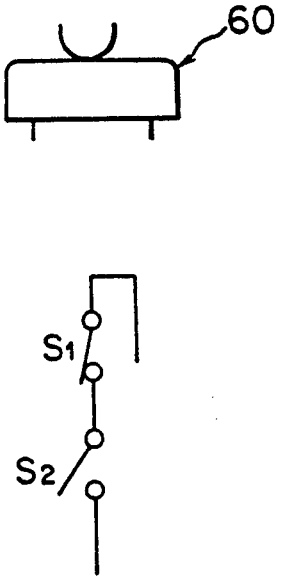
Figure 5C:
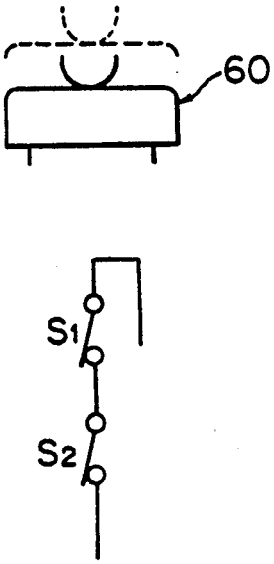

The above-described switch device having the mechanical contact mechanism and the switch device which relied upon the touch panel are mutually independent. As shown in FIG. 5, the arrangement is such that these switches actuate two contacts $S_1$, $S_2$ connected electrically in series.

The operation of the push-button switch of the present invention and the switching of the electric circuit will now be described with reference to FIG. 5.

When the touch panel 40 on the operating button 60 is not being touched, as shown in FIG. 5(*a*), a first contact $S_1$ and a second contact $S_2$ of the electric circuit are in the open state.

When the touch panel 40 on the operating button 60 is touched, as shown in FIG. 5(*b*), the first contact $S_1$ of the electric circuit is closed and the second contact remains open.

When the touch panel 40 is touched and, moreover, the operating button 60 is pressed, as shown in FIG. 5(*c*), both the first contact portion S1 and the second contact portion S2 of the electric circuit are closed for the first time, thereby closing the electric circuit.

Figure 6:
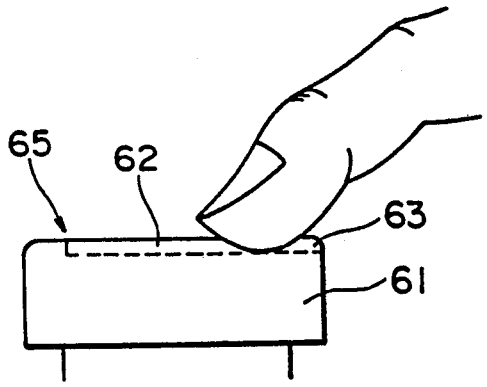
FIG. 6 is a side view showing a modification of the display surface of the operating button in the push-button switch of the present invention.

In this embodiment, the push-button cap 50 is formed to have a square hole 51 framed by four sides. However, as shown in FIG. 6, an arrangement may be adopted in which one side of the four sides of a push-button cap 61 of an operating button 65 is formed to have a cut-away portion 63 (see FIGS. 7 and 8) so as to enlarge the display surface having the touch panel 62.

Figure 7:
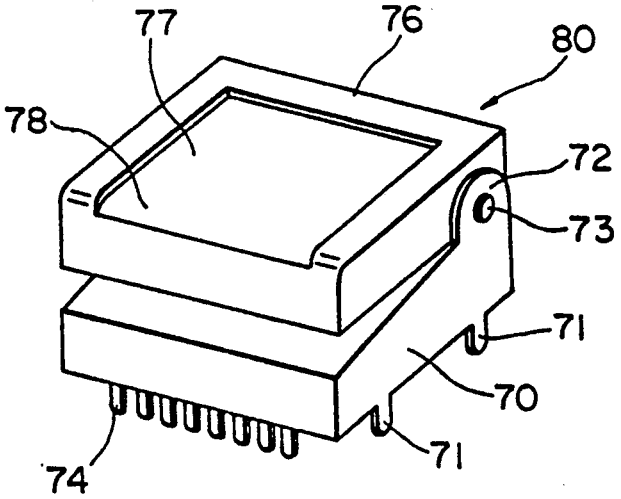
FIG. 7 is a perspective view showing a piano-touch type push-button switch illustrating another embodiment of the present invention.
Figure 8:
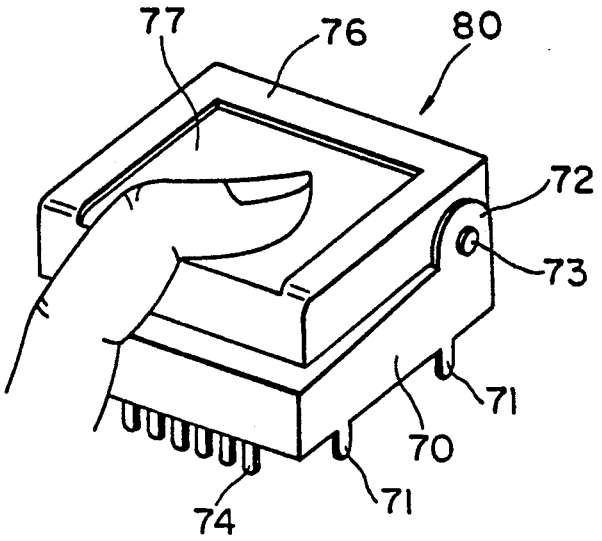
FIG. 8 is a perspective view showing the operated state of the push-button switch illustrating the other embodiment of the present invention.
Figure 9:
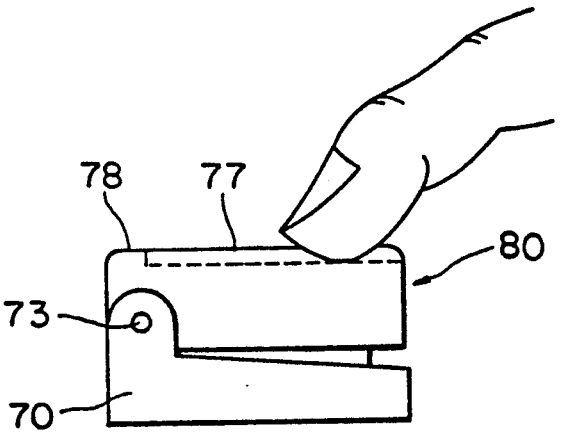
FIG. 9 is a side view showing the operated state of the push-button switch illustrating the other embodiment of the present invention.
Figure 10A:
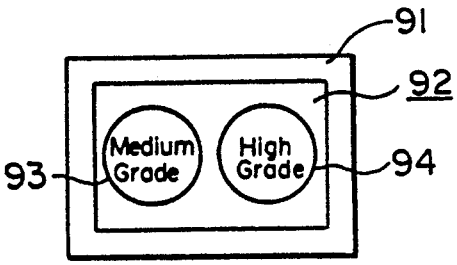
FIGS. 10(*a*) through 10(*d*) are plan views illustrating various display modes presented by the display device on the top side of the push-button switch of the present invention.
Figure 10B:
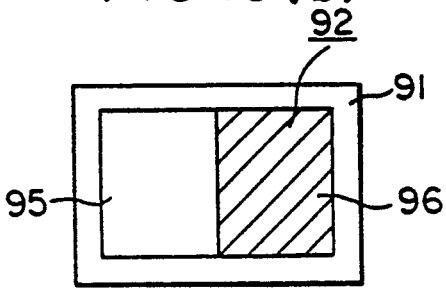
Figure 10C:
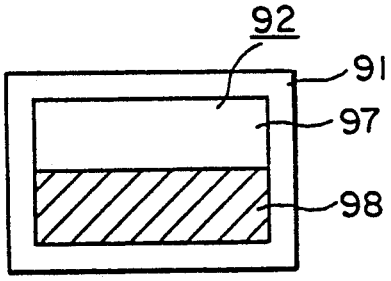
Figure 10D:
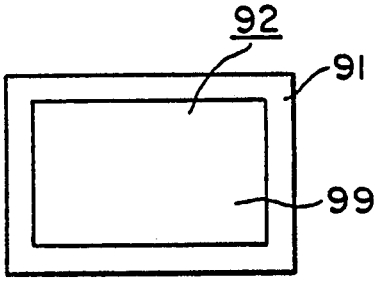

As illustrated in FIGS. 7 through 9, a switch body 70 has a structure substantially similar to that of the foregoing embodiment and is provided with fixing pieces 71 and terminals 74. Furthermore, the switch body 70 is formed to have a projection 72 provided with a hole in order that a piano-touch type operating button 80 may be pivotally supported on the switch body.

The operating button 80 has a structure substantially similar to that of the foregoing embodiment. The top surface of the operating button 80 has a touch panel 77, and the button is provided with a push-button cap 76. The push-button cap 76 is provided with a rearwardly located shaft 73, which is pivotally received in the hole formed in the projection 72 of switch body 70. Upon being pressed, the operating button 80 turns about the shaft 73, as shown in FIG. 7.

Further, the push-button cap 76 is provided with a cut-away portion 78 on one side of the four side of the frame, namely the one side opposite that on which the push-button cap 76 is pivotally attached.

Accordingly, since the frame on the top side of the operating button is generally C-shaped and the inner side is adopted as the display surface, the display surface can be widened correspondingly, thereby providing excellent visibility.

The internal structure of the push-button is as set forth above. The switch further includes the display surface having the LCD element constituting the touch panel of the push-button cap, which constructs the operating button. As illustrated in FIGS. 10(*a*)–(*d*), the display surface is made to present various displays of the push-button switch function by an IC chip (not shown) having a driver circuit, and the switching operation can be performed by moving the operating button up and down.

In FIG. 10(*a*), the top side of an operating button 91 has a display surface 92 the left and right sides of which include circular illumination display portions 93, 94 that can be made to display characters. As shown in FIG. 10(*b*), the top side of the operating button 91 has a display surface 92 divided into left and right halves to provide display portions 95, 96 having different color tones. As illustrated in FIG. 10(*c*), the top side of the operating button 91 has a display surface 92 divided into upper and lower halves to provide display portions 97, 98 having different color tones. Finally, as depicted in FIG. 10(*d*), the top side of the operating button 91 has a display surface 92 in which a display portion 99 is capable of being illuminated in a single color.

The control system for the display device of the push-button switch will now be described with reference to FIG. 11.

Figure 11:
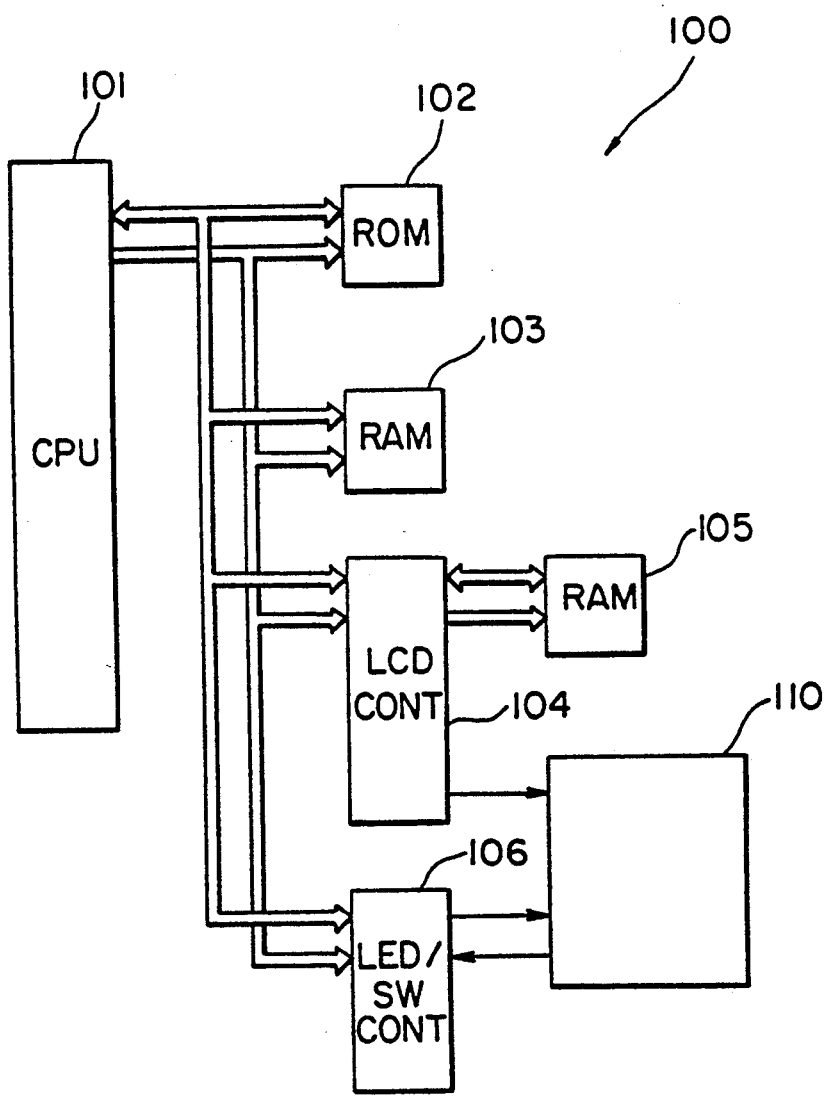
FIG. 11 is a block diagram showing the control system of the display device in the push-button switch of the present invention.

As shown in FIG. 11, a control system 100 for the display device of the push-button switch comprises a CPU (central processing unit) 101, a ROM (read-only memory) 102 which incorporates a control program and a display program, a RAM (random-access memory) 103, a controller 104 for controlling a liquid-crystal display device (LCD), a RAM 105 connected to the controller 104, and LED switch controller 106, and a display device 110. In the present invention, the display presented on the display portion of the display device 110 is capable of being altered.

It should be noted that an arrangement is permissible in which the touch panel employs static-electric means in place of the switch device relying upon the aforementioned transparent electrodes, in which case contact by a finger would cause discharge of an electric charge, thereby making is possible to sense the finger contact.

Furthermore, an arrangement may be adopted in which the illumination based upon a change in the color tones employs a color liquid crystal instead of a light-emitting diode.

It should be noted that the present invention is not limited to the foregoing embodiment but can be modified in different ways based upon the gist of the invention, and that these modifications fall within the scope of the claims.

In accordance with the present invention, the following advantages can be obtained:

(1) A plurality of switching devices, namely a switch device which relies upon the touch panel on the top surface of the operating button and a switch device which relies upon up-and-down movement of the operating button, are arranged so as to be connectable. Accordingly, an electric circuit will not be opened or closed merely by a hand touching the touch panel. The arrangement is such that the electric circuit can be opened or closed only by first touching the touch panel and then moving the operating button up or down. As a result, the electric circuit will not be switched even if an arm or an object is inadvertently brought into contact with the push-button.

(2) Since the touch panel is disposed on top of the LCD element, the push-button switch can be made to play the role of a plurality of switches owing to the combination of the plurality of functions of the touch panel and the contact mechanism. This makes it possible to greatly increase the range of selection as well as functionality.

(3) The push-button switch of the invention can be exploited also as a touch switch of the type closed merely by being contacted with a finger. In such case, since the switch has a structure in which the operating button descends, the switch absorbs impact upon the finger or wrist, thereby preventing finger pain. This also alleviates operator fatigue resulting from operating the push-button.

(4) The characters and symbols of the LCD element can be converted, and it is possible to subdivide the display presented on the display surface. As a result, the functions of the pixels switch can be increased several-fold and a single switch can be made to play several to tens of roles. This makes it possible to conserve a large amount of space in equipment.

(5) Since the switching device which relies upon the touch panel is provided on the top side of the operating button, the switch does not take on a large size and can be constructed compactly regardless of the fact that a plurality of switching devices are provided on a single operating button.

(6) The light-emitting element is disposed below the LCD element, the illuminating surface can be changed in a number of colors and divided into left and right or upper and lower halves, and the color tones of these portions of the illuminating surface can be changed. This makes it possible to establish a wider range of display modes and to select these modes.

(7) Claws which engage and lock with the inner surface of the push-button in a resilient manner are provided at the lower part of the push-button, namely on the left and right side surfaces of the plunger. As a result, the push-button can be replaced with ease, and the color tone and shape of the push-button can readily be changed effortlessly. Similarly, when the LCD element is replaced or the push-button is damaged, replacement can be performed very easily.

Furthermore, the flexible printed wiring board led out of the switch can detached freely by a connector disposed on the corresponding switch body or on a printed circuit board.

What we claim is:

1. A push-button mechanism with a surface display for switching an electric circuit between open and closed states, said push-button mechanism comprising:
   - a pair of make-break electric switches connected in series;
   - means for connecting said pair of electric switches to the electric circuit;
   - a push-button having an upper surface and a touch panel, providing the surface display, incorporated into said upper surface,
   - a switch base;
   - connecting means for connecting said push-button to said switch base and providing for reciprocating movement of said push-button relative to said switch base;
   - means for opening and closing a first of said pair of electric switches responsive to operation of said touch panel;
   - means for opening and closing a second of said pair of electric switches responsive to said reciprocating movement, whereby the switching of the electric circuit requires both the operation of said touch panel and the reciprocating movement of the push-button.

2. A push-button switch according to claim 1, wherein said touch panel is a transparent-electrode switch and further comprising an LCD element mounted in said push-button below said touch panel.

3. A push-button switch according to claim 1, wherein said push-button includes a frame having a generally C-shaped configuration, and wherein said touch panel is arranged inside of said frame.

4. A push-button switch according to claim 2, additionally comprising a light-emitting element disposed below said LCD element for providing color illumination of said surface display with different illuminating colors in different areas of said surface display.

5. A push-button switch according to claim 1, wherein the reciprocating movement of the push-button is linear.

6. A push-button switch according to claim 1, wherein said push-button mechanism is a piano-key type switch.

7. A push-button switch according to claim 1, wherein said touch panel is a membrane switch.

* * * * *

UNITED STATES PATENT AND TRADEMARK OFFICE

CERTIFICATE OF CORRECTION

PATENT NO. : 5,278,362

DATED : January 11, 1994

INVENTOR(S) : Shigeo Ohashi

It is certified that error appears in the above-identified patent and that said Letters Patent is hereby corrected as shown below:

Columns 1-6, should be deleted to appear as per attached columns 1-6.

Signed and Sealed this

Fifteenth Day of November, 1994

*Attest:*

*Attesting Officer*

BRUCE LEHMAN

*Commissioner of Patents and Trademarks*

PUSH-BUTTON SWITCH WITH DISPLAY DEVICE

BACKGROUND OF THE INVENTION

This invention relates to a push-button switch and, more particularly, to a push-button switch with a display device, in which a touch panel is arranged on the top side of a push-button switch and a plurality of switching devices are disposed on a single operating button.

In the prior art, a push-button switch of this kind is provided with an LCD (liquid-crystal display) element arranged as a display device on the top side of an operating button. The LCD element is made to display the function of the push-button switch by an IC having a driver circuit and the like, and the switching operation is performed by moving the operating button up and down.

In another example of such a push-button switch, an LCD element is arranged on the under side of a transparent-electrode switch of the type in which transparent electrodes are set on the inner surfaces of a pair of transparent, electrically insulative sheets arranged facing each other across a prescribed gap. The LCD element is made to display the function of the transparent-electrode switch, and the switching operation is performed by pressing the transparent electrodes of the transparent-electrode switch thus made to present a display.

A disadvantage of these conventional push-button switches is that the switch can be operated accidentally as a result of the push-button being contacted inadvertently by the arm or some other object. This can cause the generation of an erroneous signal and result in a changed display while the operator is unaware. One consequence can be a major accident.

Another problem is that since the switch having the touch panel is operated merely by touching the panel with a finger, the operator has no sensation of having actually operated the switch. In other words, the switch does not provide the operator an adequate operating sensation.

SUMMARY OF THE INVENTION

An object of the present invention is to provide a push-button switch with a display device adapted to prevent the aforementioned problem, namely erroneous operation of the push-button switch due to carelessness, and to obtain an adequate operating sensation, and which has a plurality of switching devices, the operating direction of which is made the same.

According to the present invention, the foregoing object is attained by providing a push-button switch, equipped with a display device, for switching an electric circuit by pressing an operating button, wherein there is provided a switch device having a touch panel disposed on the top side of the operating button, in addition to a switch device operated by up-and-down movement of the operating button, whereby a plurality of switching devices are operated by a single operating button.

In accordance with the present invention, a switch device having a touch panel disposed on the top side of an operating button is provided in addition to a switch device operated by up-and-down movement of the operating button, as set forth above. As a result, the electric circuit cannot be switched merely by touching the touch panel on the top side of the operating button. The electric circuit can be switched only by both touching the touch panel and pressing down the operating button as well.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

Figure 2:
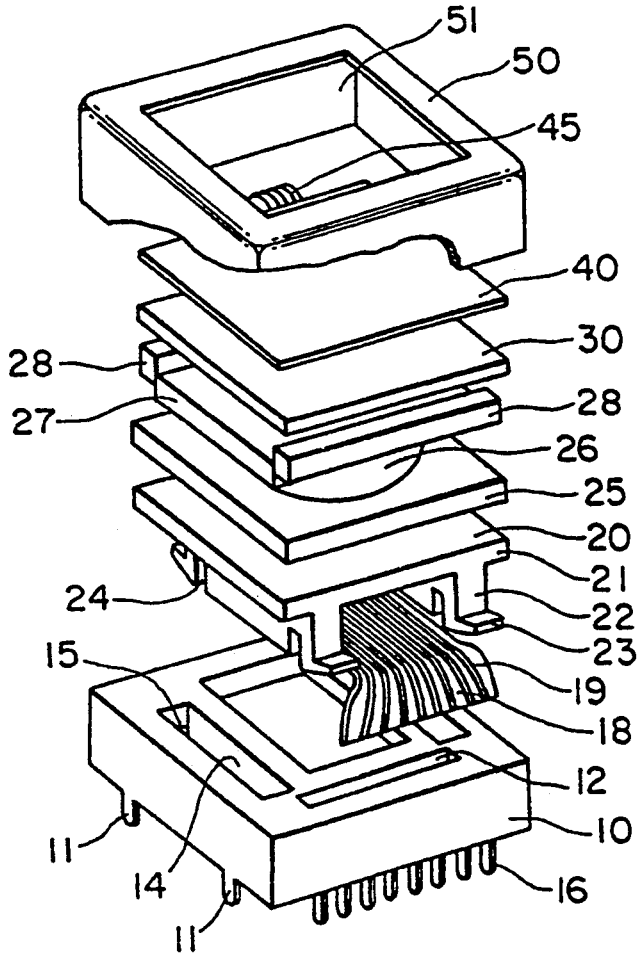
FIG. 2 is an exploded perspective view of the push-button switch illustrating the embodiment of the present invention.
Figure 3:
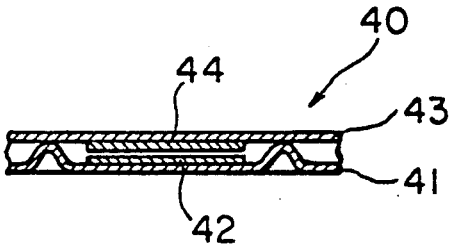
FIG. 3 is a partially enlarged sectional view of a touch panel in the push-button switch illustrating the embodiment of the present invention.
Figure 4:
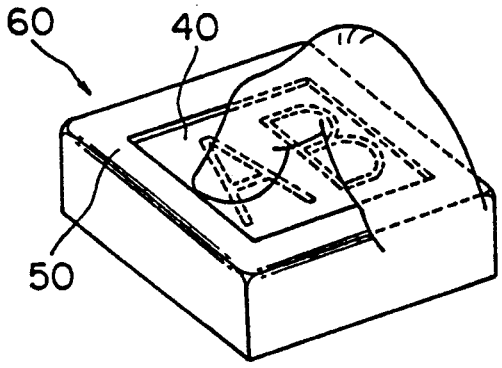
FIG. 4 is a perspective view showing the operated state of the push-button switch illustrating the embodiment of the present invention.

FIG. 1 is a perspective view of a push-button switch illustrating an embodiment of the present invention;

FIG. 2 is an exploded perspective view of the push-button switch of FIG. 1;

FIG. 3 is a partially enlarged sectional view of a touch panel in the push-button switch illustrated in FIG. 1;

FIG. 4 is a perspective view illustrating operation of the push-button switch in FIG. 1;

FIGS. 5(*a*) through 5(*c*) are schematic views illustrating operation of the push-button switch of FIG. 1 and the corresponding switching of an electric circuit;

FIG. 6 is a side view showing a modification of the display surface of the operating button in the push-button switch of FIG. 1;

FIG. 7 is a perspective view showing a piano-touch type push-button switch in a second embodiment of the present invention;

FIG. 8 is a perspective view illustrating operation of the the push-button switch of the second embodiment of the present invention;

FIG. 9 is a side view illustrating operation of the push-button switch of the second embodiment of the present invention;

FIGS. 10(*a*) through 10(*d*) are plan views illustrating various display modes presented by the display device on the top side of the push-button switch of the present invention; and FIG. 11 is a block diagram showing the control system of the display device in the push-button switch of the present invention.

DESCRIPTION OF THE PREFERRED EMBODIMENTS

An embodiment of the present invention will now be described in detail with reference to the drawings.

As seen in FIGS. 1 through 5(*a*)–(*c*), a switch body 10 is provided with projections 11, which extend downwardly from the lower portion of the switch body 10, for fixing the switch body 10 to a substrate (not shown). The upper portion of the switch body 10 has a connecting hole for receiving a connector 12, a plunger insertion hole 14, etc. One edge of a strip-shaped flexible printed wiring board 18 on which a circuit pattern 19 is formed is inserted into the connector connecting hole 12, and the terminus of the flexible printing wiring board 18 is connected to terminals 16 secured to the switch body 10. The other edge of the flexible printed wiring board 18 is connected to a circuit pattern (not shown) on a printed circuit board 25. Current is fed to an IC chip 26, a light-emitting diode (LED) 27 and an LCD element (liquid-crystal display device) 30 via the circuit pattern. In addition, the LCD element 30 and the light-emitting diode 27, etc., are driven by the IC chip 26, which is mounted on the printed circuit board 25, via the circuit pattern. A touch panel 40 is disposed on the LCD element 30. The touch panel 40, as shown, for

BEST AVAILABLE COPY example, in FIG. 3, includes a lower transparent insulative sheet 41 on which a transparent electrode (ITO, for example) 42 is provided, and an upper transparent insulative sheet 43 on which a transparent electrode (ITO, for example) 44 is provided. The transparent electrodes 42, 44 are arranged to oppose each other. A push-button cap 50, in which a square cavity 51 is formed, covers the touch panel 40, the LCD element 30, connectors 28, the light-emitting diode 27 and the printed circuit board 25 while leaving the top side of the touch panel 40 exposed.

As described above, the touch panel 40 and the LCD element 30 are provided within the cavity 51 of push-button cap 50, and the connectors 28 are arranged opposing the bottom side of the LCD element 30 to effect a connection to the circuit pattern on the printed circuit board 25.

Further, the light-emitting element (LED) 27 is arranged so as to oppose, at right angles, both connectors 28 on the bottom side of the LCD element 30.

A plunger 20 is situated below the printed circuit board 25. The plunger 20, which has a generally C-shaped configuration, comprises a horizontal planar portion 21 and a depending portion 22 extending downwardly from both the left and right sides of the horizontal planar portion 21. The depending portion 22 has a resilient claw 23 protruding from the side face of the depending portion 22. Numeral 24 denotes a notch for imparting flexibility to the resilient claw 23. When the resilient claw 23 is pressed into the plunger insertion hole 14, the resilient claw 23 engages a recess 15 within the plunger insertion hole 14, whereby the plunger 20 is locked in place.

The plunger 20 is installed with the outer peripheral surface of its horizontal planar portion 21 fitted into a recess (not shown) provided in the inner surface of the push-button cap 50. In a case where the push-button cap 50 is to be removed, the depending portion 22 is pressed inwardly by a jig such as a screwdriver, to allow the push-button cap 50 to be pulled off in the upward direction.

The flexible printed wiring board 18 is flexed and bent within the generally C-shaped interior of the plunger 20, and the distal end thereof is connected to the terminals 16, which serves as a connecting member, provided on the switch body 10. The depending portions 22 on each of the two sides of the plunger 20 are inserted into the corresponding plunger insertion hole 14 of the switch body 10, thereby installing the plunger. By pressing an operating button 60, the plunger 20 descends to actuate the driving portion of an ordinary contact mechanism, thereby opening and closing the contacts of an electric circuit.

On the other hand, when the touch panel 40 is touched, the transparent electrodes 42 and 44 are brought into contact to close the electric circuit between them. Operation of the touch panel 40 is controlled by connection to the IC chip 26, which is mounted on the printed circuit board 25, via a lead 45.

The above-described switch device having the mechanical contact mechanism and the touch panel switch device are mutually independent. As shown in FIG. 5, the arrangement is such that these switches actuate two contacts $S_1$, $S_2$ connected electrically in series.

The operation of the push-button switch of the present invention and the switching of the electric circuit When the touch panel 40 on the operating button 60 is not being touched, as shown in FIG. 5(*a*), first contact $S_1$ and a second contact $S_2$ of the electric circuit are open.

When the touch panel 40 on the operating button 60 is touched, as shown in FIG. 5(*b*), the first contact $S_1$ of the electric circuit is closed and the second contact remains open.

When the touch panel 40 is touched and, moreover, the operating button 60 is pressed, as shown in FIG. 5(*c*), both the first contact $S_1$ and the second contact $S_2$ of the electric circuit are closed for the first time, thereby closing the electric circuit.

In this embodiment, the push-button cap 50 is formed with a square central cavity 51 framed by four sides. However, as shown in FIG. 6, the push-button cap 61 of operating button 65 may have a cut-away portion 63 (see FIGS. 7 and 8) so as to allow enlargement of the display surface of the touch panel 62.

As illustrated in FIGS. 7 through 9, a switch body 70 has a structure substantially similar to that of the foregoing embodiment and is provided with mounting tabs 71 and terminals 74. Furthermore, the switch body 70 is formed with a projection 72 having provided a hole which receives a pin 73 in order that a piano-touch type operating button 80 may be pivotally supported on the switch body.

The operating button 80 has a structure substantially similar to that of the foregoing embodiment. The top surface of the operating button 80 has a touch panel 77, and the button is provided with a push-button cap 76. The push-button cap 76 is provided with a rearwardly located shaft 73, which is pivot ally received in the hole formed in the projection 72 of switch body 70. Upon being pressed, the operating button 80 turns about the shaft 73, as shown in FIG. 7.

Further, the push-button cap 76 is provided with a cut-away portion 78 on one side of the four sides of the frame, namely the one side opposite that on which the push-button cap 76 is pivotally attached.

Accordingly, since the frame on the top side of the operating button is generally C-shaped and the open side forms part of the display surface, the display surface can be widened correspondingly, thereby providing excellent visibility.

The internal structure of the push-button is as set forth above. The switch further includes the display surface having the LCD element constituting the touch panel of the push-button cap. As illustrated in FIGS. 10(*a*)–(*d*), the display surface can present various displays of the push-button switch function by means of an IC chip (not shown) having a driver circuit, and the switching operation can be performed by moving the operating button up and down.

In FIG. 10(*a*), the top side of an operating button 91 has a display surface 92 the left and right sides of which include circular illumination display portions 93, 94 that can be made to display characters. As shown in FIG. 10(*b*), the top side of the operating button 91 has a display surface 92 divided into left and right halves to provide display portions 95, 96 having different color tones. As illustrated in FIG. 10(*c*), the top side of the operating button 91 has a display surface 92 divided into upper and lower halves to provide display portions 97, 98 having different color tones. Finally, as depicted in FIG. 10(*d*), the top side of the operating button 91 has The control system for the display device of the push-button switch will now be described with reference to FIG. 11.

As shown in FIG. 11, a control system 100 for the display device of the push-button switch comprises a CPU (central processing unit) 101, a ROM (read-only memory) 102 which incorporates a control program and a display program, a RAM (random-access memory) 103, a controller 104 for controlling a liquid-crystal display device (LCD), a RAM 105 connected to the controller 104, a LED switch controller 106, and a display device 110. In the present invention, the display presented on the display portion of the display device 110 is capable of being changed.

The touch panel may employ static-electric means in place of the aforementioned switch device having transparent electrodes, in which case contact by a finger would produce an electric discharge, which could be sensed as finger contact.

Furthermore, the change in color tones of the illumination may employ a color liquid crystal display instead of a light-emitting diode.

It should be noted that the present invention is not limited to the foregoing embodiments but can be modified in different ways without departure from the gist of the invention, and that these modifications are intended to fall within the scope of the claims.

In accordance with the present invention, the following advantages can be obtained:

(1) A plurality of switches, namely a switch device which relies upon the touch panel on the top surface of the operating button and a switch device which relies upon up-and-down movement of the operating button, are connected. Accordingly, an electric circuit will not be opened or closed merely by a hand touching the touch panel. The arrangement is such that the electric circuit can be opened or closed only by first touching the touch panel and then moving the operating button up or down. As a result, the electric circuit will not be switched even if an arm or an object is inadvertently brought into contact with the push-button.

(2) Since the touch panel is disposed on top of the LCD element, the push-button switch can be made to play the role of a plurality of switches owing to the combination of the plurality of functions of the touch panel and the contact mechanism. This makes it possible to greatly increase the range of selection as well as functionality.

(3) The push-button switch of the invention can also be used as a touch switch of the type closed merely by being contacted with a finger. In such case, since the switch has a structure in which the operating button descends, the switch absorbs impact upon the finger or wrist, thereby preventing finger pain. This also alleviates operator fatigue resulting from operating the push-button.

(4) The characters and symbols displayed by the LCD element can be changed, and it is possible to subdivide the display presented on the display surface. As a result, the functions of the pixels switch can be increased several-fold and a single switch can be made to play several to tens of roles. This makes it possible to conserve a large amount of space on the equipment.

(5) Since the switching device which relies upon the touch panel is provided on the top side of the operating button, the switch need not be large in size and can be constructed compactly, regardless of the fact that a plurality of switching devices are provided on a single operating button.

(6) Because the light-emitting element is disposed below the LCD element, the illuminating surface can be changed in a number of colors and divided into left and right or upper and lower halves, and the color tones of these portions of the illuminating surface can be changed. This makes it possible to establish a wider range of display modes and to select these modes.

(7) Claws which engage and lock the push-button in a resilient manner are provided at the lower part of the push-button, namely on the left and right side surfaces of the plunger. As a result, the push-button can be replaced with ease, and the color tone and shape of the push-button can be readily changed effortlessly. Similarly, when the LCD element is to be replaced or the push-button is damaged, replacement can be performed very easily.

Furthermore, the flexible printed wiring board leading from the switch can detached freely by a connector disposed on the corresponding switch body or on a printed circuit board.

What we claim is:

1. A push-button mechanism with a surface display for switching an electric circuit between open and closed states, said push-button mechanism comprising:
   - a pair of make-break electric switches connected in series;
   - means for connecting said pair of electric switches to the electric circuit;
   - a push-button having an upper surface and a touch panel, providing the surface display, incorporated into said upper surface,
   - a switch base;
   - connecting means for connecting said push-button to said switch base and providing for reciprocating movement of said push-button relative to said switch base;
   - means for opening and closing a first of said pair of electric switches responsive to operation of said touch panel;
   - means for opening and closing a second of said pair of electric switches responsive to said reciprocating movement, whereby the switching of the electric circuit requires both the operation of said touch panel and the reciprocating movement of the push-button.

2. A push-button switch according to claim 1, wherein said touch panel is a transparent-electrode switch and further comprising an LCD element mounted in said push-button below said touch panel.

3. A push-button switch according to claim 1, wherein said push-button includes a frame having a generally C-shaped configuration, and wherein said touch panel is arranged inside of said frame.

4. A push-button switch according to claim 2, additionally comprising a light-emitting element disposed below said LCD element for providing color illumination of said surface display with different illuminating colors in different areas of said surface display.

5. A push-button switch according to claim 1, wherein the reciprocating movement of the push-button is linear.

6. A push-button switch according to claim 1, wherein said push-button mechanism is a piano-key type switch.

7. A push-button switch according to claim 1, wherein said touch panel is a membrane switch.

* * * * *